United States Patent [19]

Jacoby

[11] 4,094,221

[45] June 13, 1978

[54] CUTTING BOARD ATTACHMENT

[76] Inventor: Charles E. Jacoby, 2142 Covington Ave., Bethlehem, Pa. 18017

[21] Appl. No.: 731,264

[22] Filed: Oct. 12, 1976

[51] Int. Cl.[2] ..... B26D 4/42

[52] U.S. Cl. ..... 83/762; 83/34; 83/527; 83/606; 30/296 R

[58] Field of Search ..... 83/762, 761, 606, 527, 83/34; 30/296 R

[56] References Cited

U.S. PATENT DOCUMENTS

| | | | |
|---|---|---|---|
| 1,551,413 | 8/1925 | Lutenberger | 83/527 |
| 1,592,735 | 7/1926 | Johnson | 83/527 |
| 1,746,744 | 2/1930 | Siegle | 83/34 |

*Primary Examiner*—Donald R. Schran
*Attorney, Agent, or Firm*—Seidel, Gonda & Goldhammer

[57] ABSTRACT

A cutting board attachment is disclosed. The attachment has a plurality of cutting fulcrums which facilitate the ease with which a conventional knife may be used for cutting frozen foods and the like.

7 Claims, 7 Drawing Figures

FIG. 1
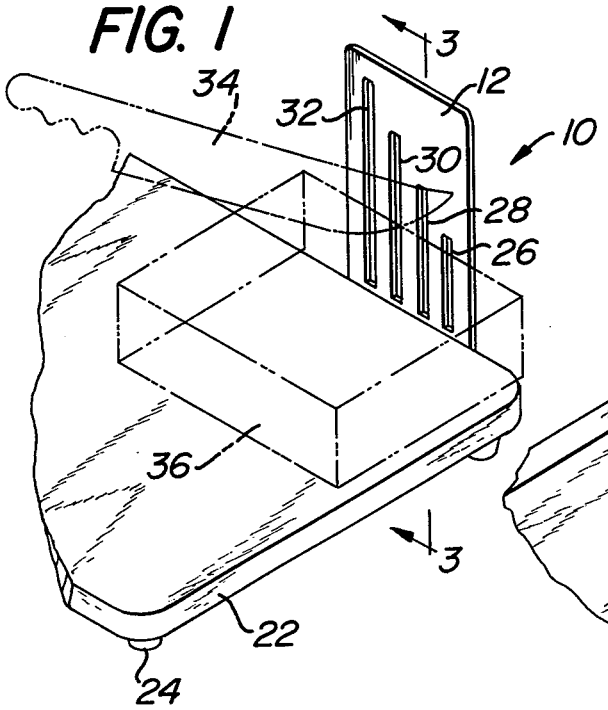
FIG. 2
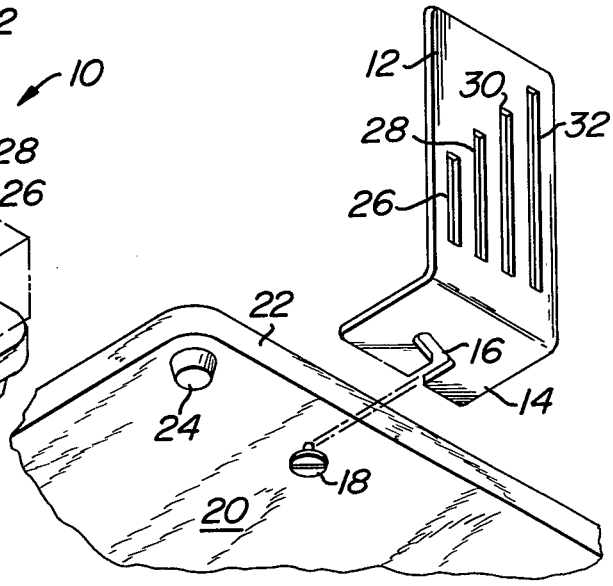
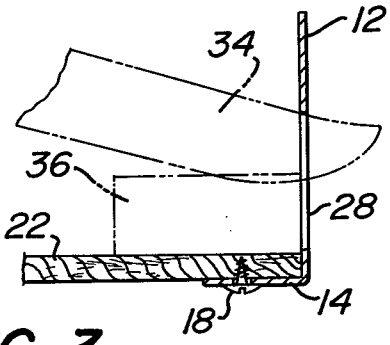
FIG. 3
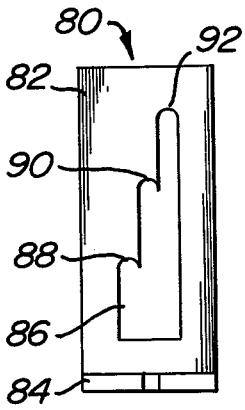
FIG. 7
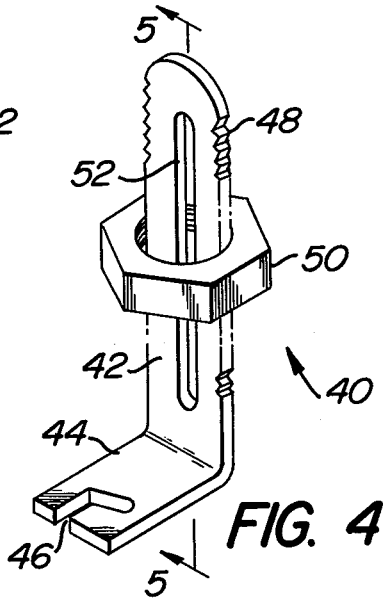
FIG. 4
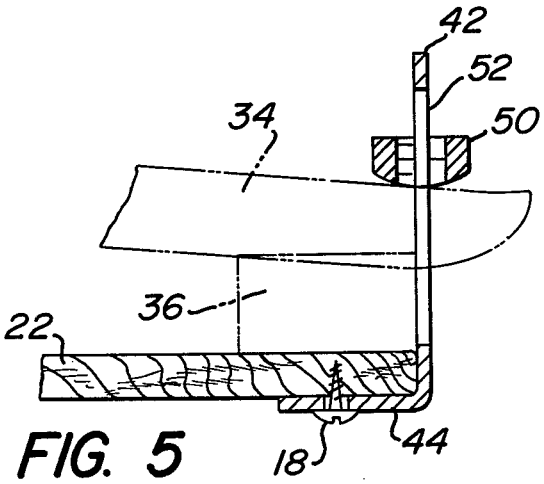
FIG. 5
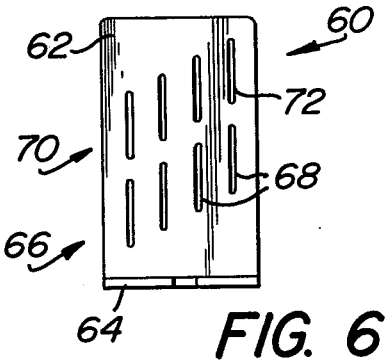
FIG. 6

CUTTING BOARD ATTACHMENT

BACKGROUND

Heretofore, it has been known to cut frozen foods by use of knives having specially designed cutting edges. The knives are only partially successful since their use requires a significant amount of strength for cutting through the frozen food. The average housewife does not have sufficient strength to use such knives. The present invention solves the problem of cutting frozen food and the like by providing an attachment to a cutting board which will enable the average housewife to cut through the frozen food with minimum effort while using a conventional knife.

SUMMARY OF THE INVENTION

The present invention is directed toward apparatus in the form of a cutting board attachment. The attachment includes a fulcrum support member adapted for use in an upright disposition with respect to a cutting board. A means is provided for mounting said support member so as to be stationary with respect to a cutting board.

A means is provided on said support member for providing a plurality of fulcrums at different elevations for receiving the tip end of a cutting blade and for contact with the upper edge of the cutting blade adjacent the tip end so that the cutting blade can be used as a lever pivotable downwardly about said fulcrums for cutting objects such as frozen food on the cutting board.

It is an object of the present invention to provide a cutting board attachment which will enable the average housewife to cut objects such as frozen food with minimum effort.

It is an object of the present invention to provide a cutting board attachment which provides a plurality of fulcrums to enable a knife to be used as a lever for cutting hard objects.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a portion of a cutting board and the attachment of the present invention.

FIG. 2 is a partial bottom perspective view of a cutting board and an exploded illustration of the attachment of the present invention.

FIG. 3 is a sectional view taken along the line 3—3.

FIG. 4 is a perspective view of an attachment in accordance with another embodiment of the present invention.

FIG. 5 is a sectional view taken along the line 5—5 in FIG. 4, with the embodiment attached to a cutting board.

FIG. 6 is a front elevation view of an attachment in accordance with a third embodiment of the present invention.

FIG. 7 is a front elevation view of another embodiment.

Referring to the drawing in detail, wherein like numerals indicate like elements, there is shown an attachment in accordance with the present invention designated generally as 10.

The attachment 10 includes a support member 10 and a flange 14 disposed at right angles with the support member 12 being vertically disposed. The attachment 10 is made from an integral piece of sheet metal bent transversely across its width so as to define member 12 and flange 14. The attachment 10 may be made from a wide variety of metals including high strength aluminum, stainless steel, etc.

At its leading edge, the flange 14 is provided with a bayonet slot defined by an entry portion perpendicular to the leading edge and a terminal portion which is angularly disposed away from the leading edge. A fastener 18, such as a screw, is adapted for cooperation with the terminal portion of slot 16 in retaining the attachment fixed to the bottom surface 20 of a cutting board 22. Surface 20 may be provided with projections 24 so as to space the board 22 from a support surface by a distance at least equal to the thickness of the flange 14. Projections 24 need not have a thickness greater than about 0.04–0.06 inches.

The support member 12 is provided with a plurality of parallel slots 26, 28, 30, and 32. Each of the slots is closed at its opposite ends. The location of the bottom end of the slots is relatively unimportant. The upper end of each of the slots 26–30 is at a different elevation as compared with the remaining slots. The upper end of each of the slots 26–32 defines a fulcrum for contact with the upper edge of the tip end of a knife 34 to be used for cutting a hard object 36 such as frozen food.

The knife 34 may be any conventional kitchen knife preferably having a length of about 10 to 12 inches. A hard object such as a package 36 of frozen food is placed on the cutting board adjacent to the attachment 10. The tip end of the knife 34 is inserted in the appropriate slot selected on the basis of the height of the package 36. In FIGS. 1 and 3, the top end of the knife 34 extends into the slot 28. Thereafter, pressure is applied in a downward direction at the handle end of the knife 34, preferably without any sawing action, to cut the package 36. The upper end of the slot 28 acts as a fulcrum and the knife acts as a lever to cut the package 36. It has been my experience that after partial cutting of the package 36, the remainder will break cleanly at the cutting zone.

In FIGS. 4 and 5, there is illustrated another embodiment of the present invention designated generally as 40. The attachment 40 is adapted to be secured to a cutting board 22 in the same manner as described above. Attachment 40 includes an upright support member 42 and a flange 44 projecting from the lower end thereof. Flange 44 at its leading edge is provided with a slot 46 comparable to slot 16.

The support member 42 is substantially narrower than the support member 12. Threads are provided along the opposite edges of member 42. A nut 50 is threaded to the threads 48. As shown more clearly in FIG. 5, the lower edge of the nut 50 is preferably rounded. Member 42 is provided with an elongated vertical slot 52.

The attachment 40 is used in the same manner as described above and as will be apparent from FIG. 5. A plurality of fulcrums at different elevations is attained by adjusting the elevation of the nut 50. At each of its various elevations, the nut 50 constitutes the fulcrum for contact with the upper edge of the tip end of the blade of knife 34.

In FIG. 6, there is illustrated a front elevation view of a third embodiment of the present invention designated generally as 60. The attachment 60 has a vertically disposed support member 62 and a flange 64 projecting from its lower end. Flange 62 has a slot comparable to slots 16 and 46. The vertically disposed support member 62 has a row of parallel slots 68 and a second row 70 of parallel slots 72. Each of the slots 72 is parallel to and at a elevation above the slots 68. The upper end of each of the slots 68, 72 constitutes a fulcrum for contact with the upper edge of the blade end of a knife.

In FIG. 7, there is ilustrated another embodiment designated generally as 80. Attachment 80 has a support member 82 and flange 84. Member 82 has a single opening 86 extending therethrough. Opening 86 has a series of shoulders 88, 90 and 92 which define discrete fulcrums at different elevations. Attachment 80 is otherwise constructed and used as described above.

The attachment of each of the embodiments of the present invention is preferably made from a layer of sheet metal. I prefer to stamp the slots in each of the embodiments while the layer of sheet metal is still flat and thereafter bend the same so as to define the support member and its associated flange. Conventional threads such as threads 48 are also stamped at the same time the slot 52 is stamped.

Typical dimensions of the support member 12 are 3 inches wide and 5 inches high with the flange 14 being 3 inches long. The attachment typically is made from 5052H38 alumnim having a thickness of 0.060 inches. Other hard materials may be used in place of the above-mentioned specific type of aluminum. It is preferred that the attachment be made from a material which is non-corrosive. With respect to attachment 10 illustrated as having four slots and attachment 60 illustrated as having eight slots, it will be appreciated that a greater or lesser number of slots may be used as desired.

The attachments of the present invention render it unnecessary for the person using the same to hold the hard objects such as package 36 with one hand thereon thereby minimizing the occasion of an accidental cutting of one's hand. Each of the attachments is readily usable for cutting other materials in addition to frozen foods and in fact could be used for dicing vegetables, cutting corn-on-the-cob, etc. It will be noted that each of the slots in the support member acts as a guide for the blade of the cutting knife.

Thus, it will be seen that the attachment of the present invention is simple, can be manufactured inexpensively, is safer than merely using specially designed cutting blades, while at the same time enables a housewife to cut frozen food of different thicknesses more easily with minimum effort.

The present invention may be embodied in other specific forms without departing from the spirit or essential attributes thereof and, accordingly, reference should be made to the appended claims, rather than to the foregoing specification as indicating the scope of the invention.

I claim:

1. Apparatus for attachment to a support surface to facilitate the use of a discrete knife as a lever for cutting hard objects comprising a fulcrum support member, said member being a L-shaped plate with one leg adapted to be vertically disposed along side a cutting block, means on the other leg of said member for facilitating attachment of said member to a cutting block, means on said one leg providing a plurality of discrete fulcrums at different elevations for contact with the upper edge of a cutting blade while receiving therein the tip of the blade so that the cutting blade can be used as a lever pivotable downwardly about the fulcrums during a cutting action, said fulcrums being spaced transversely across the width of said one leg of said support member.

2. Apparatus in accordance with claim 1 wherein said one leg of said support member has a continuous uninterrupted periphery on opposite sides thereof and at the end thereof remote from said other leg.

3. Apparatus in accordance with claim 2 wherein said means providing a plurality of fulcrums includes a plurality of parallel partially overlapping slots disposed entirely within said one leg of said member, each slot being closed at each end thereof, the upper end of at least some of said slots being at a higher elevation than the upper end of an adjacent slot.

4. Apparatus in accordance with claim 1 wherein said means for providing a plurality of fulcrums includes a plurality of discrete vertically disposed parallel slots closed at their upper end so as to define a plurality of discrete fulcrums at different elevations.

5. Apparatus in accordance with claim 1 wherein said support is made from a hard non-corrosive metal.

6. Apparatus in accordance with claim 1 wherein said last mentioned means includes a single slot having shoulders at different elevations to define said fulcrums.

7. Apparatus in accordance with claim 4 wherein said slots are arranged in at least two transverse rows with one row being at an elevation above the elevation of the other row.

* * * * *